US005858300A

United States Patent [19]

Shimizu et al.

[11] Patent Number: 5,858,300

[45] Date of Patent: Jan. 12, 1999

[54] SELF-SUSTAINING CONTAINER

[75] Inventors: Norihiro Shimizu; Tomohiro Urano; Atsushi Takei; Akira Nitta, all of Machida, Japan

[73] Assignee: Denki Kagaku Kogyo Kabushiki Kaisha, Tokyo, Japan

[21] Appl. No.: 857,587

[22] Filed: May 16, 1997

Related U.S. Application Data

[62] Division of Ser. No. 367,017, Dec. 30, 1994, abandoned.

[30] Foreign Application Priority Data

| | | | |
|---|---|---|---|
| Feb. 23, 1994 | [JP] | Japan | 6-025662 |
| Feb. 23, 1994 | [JP] | Japan | 6-025663 |
| Feb. 28, 1994 | [JP] | Japan | 6-030252 |
| Sep. 20, 1994 | [JP] | Japan | 6-224970 |
| Sep. 20, 1994 | [JP] | Japan | 6-224971 |
| Sep. 20, 1994 | [JP] | Japan | 6-224972 |

[51] Int. Cl.[6] ..... B29C 35/02

[52] U.S. Cl. ..... 264/521; 264/903; 264/907; 215/371; 215/376; 428/35.7; 428/36.92; 428/910

[58] Field of Search ..... 428/35.7, 910, 428/36.92; 215/40, 42, 370, 371, 376; 264/521, 906, 907, 903

[56] References Cited

U.S. PATENT DOCUMENTS

| | | | |
|---|---|---|---|
| 4,164,298 | 8/1979 | Nishikawa et al. | 215/42 |
| 4,233,022 | 11/1980 | Brady et al. | 264/521 |
| 4,318,882 | 3/1982 | Agrawal | 264/521 |
| 4,339,409 | 7/1982 | Curto | 264/521 |
| 4,463,121 | 7/1984 | Gartland et al. | 428/35 |
| 4,589,559 | 5/1986 | Hayashi et al. | 215/42 |
| 4,603,066 | 7/1986 | Jabarin | 215/42 |
| 4,755,404 | 7/1988 | Collette | 215/370 |
| 4,803,024 | 2/1989 | Nilsson | 264/521 |
| 4,863,046 | 9/1989 | Collette | 215/381 |
| 4,867,929 | 9/1989 | Albrecht et al. | 264/521 |
| 4,889,247 | 12/1989 | Collette et al. | 264/521 |
| 4,927,591 | 5/1990 | Nilsson | 264/521 |
| 5,205,434 | 4/1993 | Brunson et al. | 215/1 C |
| 5,409,750 | 4/1995 | Hamada et al. | 428/35.7 |
| 5,411,698 | 5/1995 | Mero et al. | 264/521 |
| 5,419,866 | 5/1995 | Valyi | 264/521 |
| 5,520,877 | 5/1996 | Collette et al. | 264/521 |

FOREIGN PATENT DOCUMENTS

| | | |
|---|---|---|
| 81202279 | 11/1990 | China . |
| 81103056 | 4/1992 | China . |

(List continued on next page.)

OTHER PUBLICATIONS

Jalandar, Jadhav D., "Thermoplastic Polyesters", Encyclopedia of Polymer Science and Engineering, vol. 12, p. 228, 1988.

Opposition issued in corresponding Taiwan Patent Application No. 83112327, published Oct. 1, 1996, w/English Translation.

*Primary Examiner*—Rena L. Dye

*Attorney, Agent, or Firm*—Oblon, Spivak, McClelland, Maier & Neustadt, P.C.

[57] ABSTRACT

A self-sustaining container made of a saturated polyester resin, formed by biaxial stretch blow molding and comprising a mouth and cervical portion, a shoulder, a body and a bottom, wherein said bottom has a self-sustaining structure with a plurality of legs radially bulged around the center of the bottom and valley lines formed between the adjacent legs, and the following portions (A) to (E) are low stretched portions and at least portions (B) and (C) among the following portions (A) to (E) are crystallized portions:

(A) center of the bottom (B) peripheral portion of the center of the bottom (C) portion of each valley line close to the center of the bottom (D) portion of each leg from the edge of the peripheral portion of the center of the bottom to a ground contact portion (E) portion between said portions (C) and (D).

24 Claims, 21 Drawing Sheets

FOREIGN PATENT DOCUMENTS

| | | | |
|---|---|---|---|
| 0 237 196 | 9/1987 | European Pat. Off. . | |
| 0 551 788 | 7/1993 | European Pat. Off. . | |
| 0 559 103 | 9/1993 | European Pat. Off. . | |
| 0 574 342 | 12/1993 | European Pat. Off. . | |
| 1244738 | 10/1986 | Japan | 215/370 |
| 2039443 | 2/1987 | Japan | 215/370 |
| 2098536 | 4/1990 | Japan | 215/370 |
| 5-85535 | 4/1993 | Japan . | |

SELF-SUSTAINING CONTAINER

This application is a Division of application Ser. No. 08/367,017, filed on Dec. 30, 1994, abandoned.

BACKGROUND OF THE INVENTION

1. Field of the Invention

The present invention relates to a self-sustaining container made of a saturated polyester resin, formed by biaxial stretch blow molding, which is suitable for filling e.g. a carbonated drink or a soft drink. More particularly, it relates to a self-sustaining container excellent in heat and pressure resistance during heat sterilization of the content.

2. Description of the Prior Art

Heretofore, as a heat and pressure resistant container, a container has been most common wherein the bottom is bulge-formed into a hemispherical shell shape to increase the internal pressure resistance of the main body of the container, and a base cup molded in the form of a closed-end cylinder, is attached thereto to impart a self-sustaining function to the container. However, use of such a base cup has various problems such that the base cup has to be separately molded, then attached and fixed to the container bottom, that the weight of the container increases, that the shape tends to be large-sized, that during the heat sterilization process, hot water does not adequately reach the bottom of the container, whereby heat sterilization of the content can not smoothly be carried out, and that in such heat sterilization, water tends to be trapped in the base cup and can not readily be removed.

From the viewpoint of conservation of resources or environmental protection, it is desired to reuse used empty containers. However, in the case of a container having a base cup attached thereto, the main body of the container and the base cup or the adhesive are made of different materials, and they must be separated for reuse, which adds to the cost of the recycling process.

In view of such problems, it has been desired to develop a heat and pressure resistant container which requires no base cup. For a pressure resistant container which requires no base cup, some proposals have been made, which are usually directed to either a champagne type structure or a structure in which a plurality of legs are radially bulged around the center of the bottom and valley lines are formed between the adjacent legs. Such structures are disclosed, for example, in Japanese Examined Patent Publications No. 5708/1973, No. 40693/1984 and No. 9170/1986 and Japanese Unexamined Patent Publications No. 202424/1988 and No. 43342/1991.

However, the containers disclosed in these publications do not provide adequate performance when they are used as heat and pressure resistant containers to be subjected to a heat sterilization process, although they may provide adequate performance as pressure resistant containers. Namely, the containers disclosed in these publications have such problems that when the temperature of the content rises to a level of from 50° to 70° C. during the heat sterilization, the internal pressure increases, and the material of the containers tends to undergo creeping, whereby the center of the bottom and the peripheral portion of the center of the bottom are likely to undergo creeping and project, whereby the container loses the self-sustaining stability.

As a method for solving this problem, it has been attempted to thermally crystallize the center of the bottom of the container. However, such a method is not desirable, since the peripheral edge of the thermally crystallized portion tends to have low strength and is likely to outwardly project by the internal pressure, and a deformation is likely to result, or stress cracking is likely to result.

The container disclosed in Japanese Unexamined Patent Publication No. 85535/1993 is the one obtained by preliminarily thermally crystallizing the center of the bottom of a preform to form a hemispherical shell-shaped bottom having a thermally crystallized bottom center and further subjecting this bottom to finish blow stretch molding by means of a mold to form legs. Such a container is the one wherein the resin remaining at the periphery of the thermally crystallized bottom center is adequately stretched and thin-walled. In this container, only the center of the bottom is crystallized, and the peripheral portion of the crystallized bottom center is thin-walled. Accordingly, when the internal pressure increases during heat sterilization, there will be a problem such that such a portion undergoes creeping, whereby the bottom will project to lose the self-sustaining stability. Or, even if the self-sustaining stability is maintained, the content level drops substantially to lose practical usefulness.

As a result of an extensive research, the present inventors have surprisingly found that in the case of a bottom structure of a biaxial stretch blow-molded self-sustaining container, wherein a plurality of legs are radially bulged around the center of the bottom and valley lines are formed between the adjacent legs, the stress by the internal pressure is concentrated especially at the peripheral portion of the center of the bottom and at the valley lines and further that in the projection of the bottom at the time of heat sterilization, creeping is particularly remarkable at the portion of each valley line close to the center.

SUMMARY OF THE INVENTION

On the basis of these discoveries, the present invention has been accomplished by improving the self-sustaining properties of the bottom and reducing its deformation, and the present invention provides a self-sustaining container having heat and pressure resistance as well as excellent chemical resistance, wherein certain specific portions of the bottom are crystallized to prevent creeping due to an increase of the internal pressure at the time of heat sterilization and thereby to prevent projection of the bottom to lose the self-sustaining stability.

Namely, in the first aspect, the present invention provides a self-sustaining container made of a saturated polyester resin, formed by biaxial stretch blow molding and comprising a mouth and cervical portion, a shoulder, a body and a bottom, wherein said bottom has a self-sustaining structure with a plurality of legs radially bulged around the center of the bottom and valley lines formed between the adjacent legs, and the following portions (A) to (E) are low stretched portions and at least portions (B) and (C) among the following portions (A) to (E) are crystallized portions:

(A) center of the bottom (B) peripheral portion of the center of the bottom (C) portion of each valley line close to the center of the bottom (D) portion of each leg from the edge of the peripheral portion of the center of the bottom to a ground contact portion (E) portion between said portions (C) and (D).

In the second aspect, the present invention provides a self-sustaining container made of a saturated polyester resin, formed by biaxial stretch blow molding and comprising a mouth and cervical portion, a shoulder, a body and a bottom, wherein said bottom has a self-sustaining structure with a plurality of legs radially bulged around the center of the bottom and valley lines formed between the adjacent legs, and at least one portion selected from the following portions (A) to (E) is a crystallized portion, and said mouth and cervical portion and a non-stretched portion of a neck connecting said mouth and cervical portion and said shoulder, are crystallized portions:

(A) center of the bottom (B) peripheral portion of the center of the bottom (C) portion of each valley line close to the center of the bottom (D) portion of each leg from the edge of the peripheral portion of the center of the bottom to a ground contact portion (E) portion between said portions (C) and (D).

In the third aspect, the present invention provides a self-sustaining container made of a saturated polyester resin, formed by biaxial stretch blow molding and comprising a mouth and cervical portion, a shoulder, a body and a bottom, wherein said bottom has a self-sustaining structure with a plurality of legs radially bulged around the center of the bottom and valley lines formed between the adjacent legs, and at least one portion selected from the following portions (A) to (E) is a crystallized portion, the inner diameter of said mouth and cervical portion is from 60 to 90% of the outer diameter thereof, said mouth and cervical portion has a threaded section, at least this threaded section has residual internal stress and strain reduced by heat treatment, and said mouth and cervical portion and a non-stretched portion of a neck connecting said mouth and cervical portion and said shoulder, are crystallized portions:

(A) center of the bottom (B) peripheral portion of the center of the bottom (C) portion of each valley line close to the center of the bottom (D) portion of each leg from the edge of the peripheral portion of the center of the bottom to a ground contact portion (E) portion between said portions (C) and (D).

DETAILED DESCRIPTION OF THE PREFERRED EMBODIMENTS

Now, the present invention will be described in detail with reference to the preferred embodiments. From the viewpoint of the strength, transparency and gas barrier properties, the saturated polyester resin to be used in the present invention is preferably a thermoplastic polyester resin wherein main repeating units are ethylene terephthalate. As such a thermoplastic polyester resin, the one having a homopolymer of polyethylene terephthalate as the main component, is preferred.

Such a thermoplastic polyester resin may be the one wherein a part of the terephthalic acid component is substituted by at least one type of other bifunctional carboxylic acids, such as aromatic dicarboxylic acids such as isophthalic acid, naphthalene dicarboxylic acid, diphenyl dicarboxylic acid, diphenoxyethane dicarboxylic acid, diphenyl ether dicarboxylic acid and diphenylsulfone dicarboxylic acid; alicyclic dicarboxylic acids such as hexahydroisophthalic acid; aliphatic dicarboxylic acids such as adipic acid, sebacic acid and azelaic acid; and oxy acids such as p-β-hydroxyethoxybenzoic acid and ϵ-hydroxycaproic acid, for copolymerization.

Further, the thermoplastic polyester resin may be a copolymer obtained by having a part of the ethylene glycol component substituted for copolymerization by at least one type of other glycols and polyfunctional compounds as their functional derivatives, such as trimethylene glycol, tetramethylene glycol, hexamethylene glycol, decamethylene glycol, neopentylene glycol, diethylene glycol, 1,1-cyclohexane dimethylol, 1,4-cyclohexane dimethylol and 2,2(4'-β-hydroxyethoxyphenyl)sulfonic acid.

The thermoplastic polyester resin to be used for the container of the present invention preferably has an intrinsic viscosity of from 0.7 to 0.9, more preferably from 0.75 to 0.85.

Further, additives such as a coloring agent, a heat deterioration-preventing agent, an antioxidant, an ultraviolet absorber, an antistatic agent, a fungicide and a lubricant, may be incorporated to the thermoplastic polyester resin to be used in the present invention, as the case requires.

Figure 1:
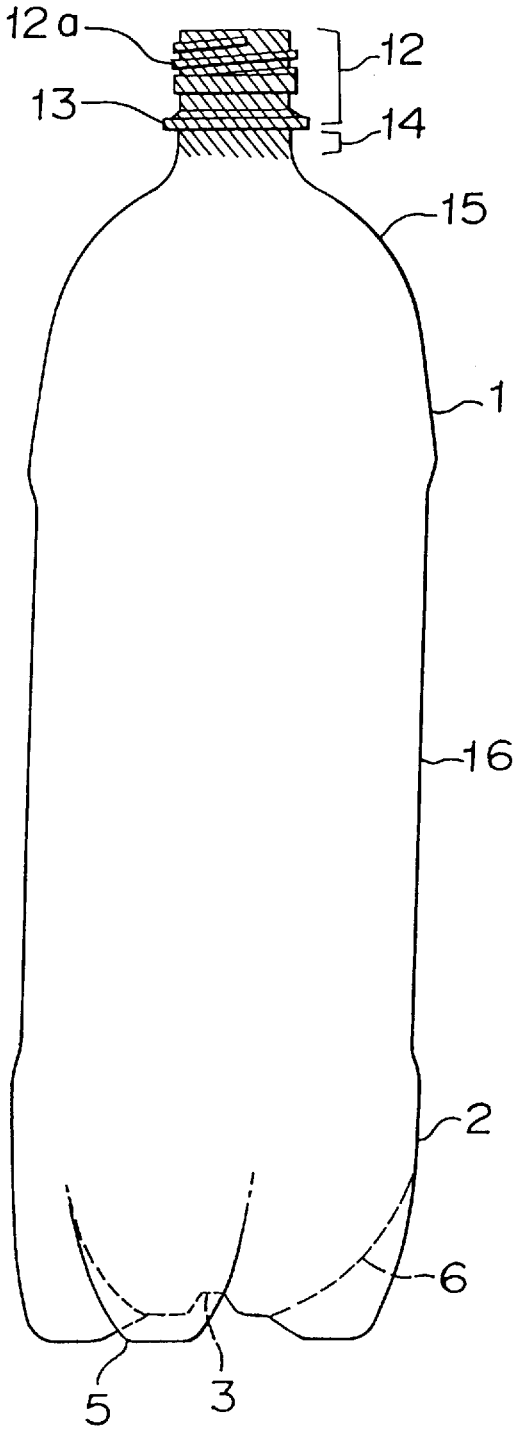
FIG. 1 is a front view of a self-sustaining container of the present invention.

In the present invention, the container used for crystallizing the bottom is a container, as shown by reference numeral 1 in FIG. 1, wherein the portions (A) to (E) of the bottom, as shown by reference numeral 2 in FIG. 1, are low stretched portions. Here, the low stretched portions are meant for portions at which the draw ratio of the portions (A) to (E) of the bottom is low as compared with the draw ratio of the body.

In the present invention, among the portions (A) to (E), crystallized portions are opaque, and non-crystallized portions are transparent.

Figure 26:
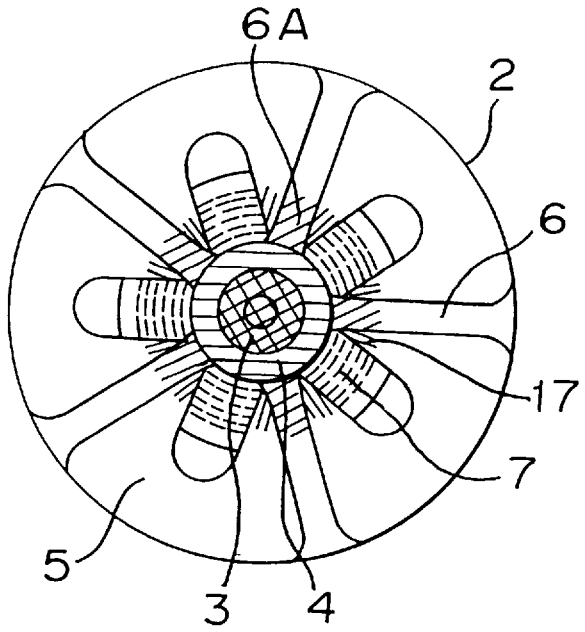
FIG. 26 is a view illustrating various parts of the container bottom of the present invention.
Figure 27:
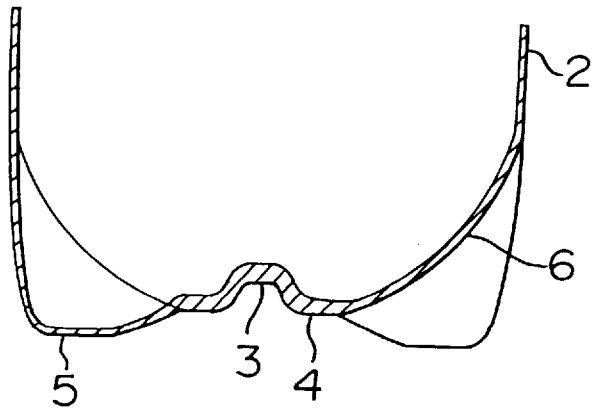
FIG. 27 is a cross-sectional view of the container bottom shown in FIG. 26.

In the present invention, the center (A) of the bottom is the portion shown, for example, by reference numeral 3 in FIG. 26. Likewise, the peripheral portion (B) of the center of the bottom is the portion shown by reference numeral 4 in FIG. 26. The portion (C) of each valley line close to the center of the bottom is a portion in the valley line close to the center and corresponds to from 5 to 85%, preferably from 10 to 50%, of the entire valley line, and it is the portion shown, for example, by reference numeral 6A in FIG. 26. The portion (D) of each leg from the edge of the peripheral portion of the center of the bottom to a ground contact portion is a portion in each leg which extends from the edge of the peripheral portion of the center of the bottom to a ground contact portion, and corresponds to the portion shown, for example, by reference numeral 7 in FIG. 26. The portion (E) between the portion of each valley line close to the center of the bottom and the portion of each leg from the edge of the peripheral portion of the center of the bottom to a ground contact portion, is the portion shown, for example, by reference numeral 17 in FIG. 26.

In the present invention, specific portions selected from the portions (A) to (E) of the bottom of the container are crystallized. A preferred combination of the crystallized portions is a combination containing the portions (B) and (C). A particularly preferred combination is one of the following combinations (a) to (e):

(a) combination of (A), (B) and (C)

(b) combination of (A), (B), (C) and (D)

(c) combination of (A), (B), (C), (D) and (E)

(d) combination of (B), (C) and (D), and (e) combination of (B), (C), (D) and (E).

By such crystallization of the bottom of the container, it is possible to suppress the creeping of the bottom of the container during heat sterilization.

In the present invention, a heat-generating apparatus can be employed as the heating apparatus for crystallizing the portions (A) to (E) of the bottom of the container. Specifically, an infrared heater, a hot air, an infrared lamp, a quartz-sheathed element heater or a high frequency heating apparatus may, for example, be mentioned. A heating apparatus other than these may, of course, be used.

As a method for crystallizing the bottom of the container, a method may, for example, be mentioned in which a shielding plate having a slit is provided between a heat source and the bottom of the container, and a desired portion of the bottom of the container is heated for thermal crystallization, through the slit provided in this shielding plate.

One side of this shielding plate preferably has a shape which fits the bottom of the container. Accordingly, the surface shape of one side of the shielding plate preferably has a concave shape which is the same shape as the bottom of the container and which fits the bottom of the container. The heat of the heat source provided on the opposite side of the container, reaches the bottom of the container through the slit of the shielding plate, whereupon the desired portion of the bottom is crystallized by the heat. It is preferred to maintain the surface temperature of the shielding plate at a constant level of not higher than Tg of the material of the container by circulating e.g. cooling water or warm water and thereby to prevent the portion contacting the bottom of the container from being heated to a high temperature exceeding Tg. As the material for this shielding plate, a metal such as aluminum, iron or copper, a heat resistant resin or ceramics may, for example, be employed.

As another method, a method may be mentioned wherein the bottom of the container is heated by a die which has the same shape as the portion of the container bottom to be crystallized and which is heated to a high temperature. As such a high temperature die, a high temperature die formed by a metal having a heat-generating means such as a heater embedded to adjust the temperature, a metal having a pipe, as shown by reference numeral 10 in FIG. 5, for a heating medium such as oil or steam embedded to adjust the temperature, or a metal having the heating temperature adjusted by radiation by e.g. an infrared heater or a hot air, may, for example, be employed.

The crystallized portions of the bottom of the container of the present invention are opaque and have a density of polyethylene terephthalate of from 1.350 g/cm$^3$ to 1.390 g/cm$^3$, particularly preferably from 1.355 g/cm$^3$ to 1.385 g/cm$^3$. If the density of the crystallized portions is less than 1.350 g/cm$^3$, the bottom tends to undergo creeping and is likely to expand by the internal pressure at the time of heat sterilization of the container, whereby the self-sustaining stability is likely to be lost, and the commercial value is likely to be lost. On the other hand, if it exceeds 1.390 g/cm$^3$, the impact strength of the crystallized portions tends to be low, and it is likely that the bottom breaks when a dropping impact is exerted to the container.

The self-sustaining container of the present invention is excellent in the heat and pressure resistance, as the bottom has a self-sustaining structure with a plurality of legs radially bulged around the center of the bottom and valley lines formed between the adjacent legs, and certain specific portions selected from the above-mentioned portions (A) to (E) are crystallized portions. In order to have the heat and pressure resistance of the container further improved, it is preferred that at least one portion selected from the above-mentioned portions (A) to (E) of the bottom is a crystallized portion, and the mouth and cervical portion and a non-stretched portion of a neck connecting the mouth and cervical portion and the shoulder, are crystallized, as mentioned above as the second aspect of the present invention, or the inner diameter of the mouth and cervical portion is from 60 to 90% of the outer diameter thereof, and the mouth and cervical portion has a threaded section, at least this threaded portion has residual internal stress and strain reduced by heat treatment, and a non-stretched portion of a neck connecting the mouth and cervical portion and the shoulder, is a crystallized portion, as mentioned above as the third aspect of the present invention.

In the second aspect of the present invention, the mouth and cervical portion of the container and the non-stretched portion of a neck connecting the mouth and cervical portion and the shoulder are crystallized portions. The non-stretched portion of a neck connecting the mouth and cervical portion and the shoulder, as shown by reference numeral 15 in FIG. 1, is meant for, for example, the portion 14 below a neck support ring, shown by oblique lines in FIG. 1. Such a non-stretched portion can be obtained by crystallizing the portion below the neck support ring of a preform or both the portion below the neck support ring and the mouth and cervical portion, followed by biaxial stretch blow molding to conduct the molding so that a non-stretched non-crystallized portion will not remain at the neck. By the crystallization of such a portion, creeping during heat sterilization can be suppressed. If this portion is not crystallized, such a portion undergoes creeping during heat sterilization, and the total height and the volume of the container will increase so much that the container will lose practical usefulness.

The mouth and cervical portion of the container of the second aspect of the present invention is a crystallized portion obtained by heating the preform at a temperature of from 100° to 250° C. for thermal crystallization. By such crystallization, heat shrinkage of the mouth and cervical portion which takes place at the time of heat sterilization of the container, can be suppressed. Further, by the crystallization of the mouth and cervical portion, the modulus of elasticity of the material substantially increases as compared with the non-crystallized state, whereby a deformation due to the squeezing force by the cap can be prevented. If this portion is not crystallized, such a portion tends to undergo remarkable heat shrinkage during heat sterilization or tends to undergo a deformation due to the squeezing force by the cap, whereby leakage of the content or intrusion of bacteria is likely to result, and practical usefulness is likely to be lost.

According to the third aspect of the present invention, the mouth and cervical portion of the container is heated to a temperature of from 70° to 130° C. to reduce the residual internal stress and strain of the material and then gradually cooled so that no strain will form. It is thereby possible to obtain a self-sustaining container having adequate heat resistance and a transparent mouth and cervical portion, whereby heat shrinkage of the mouth and cervical portion during heat sterilization is little. Further, the threaded portion is not whitened or crystallized, whereby no abrupt shrinkage takes place at the time of reducing the residual internal stress and strain of the material, and thus it is excellent also in the dimensional precision.

According to the third aspect of the present invention, the inner diameter of the mouth and cervical portion is from 60 to 90%, preferably from 74 to 77%, of the outer diameter thereof. It is thereby possible to prevent the deformation due to the squeezing force by the cap during heat sterilization and thereby to obtain excellent performance. If it is less than 60%, the wall thickness of the mouth portion tends to be so thick that such is not desirable from the viewpoint of the appearance, and there will be a problem such that a nozzle can not smoothly be inserted at the time of filling the content. On the other hand, if it exceeds 90%, the wall thickness of the mouth portion tends to be so thin that the strength tends to be low, whereby a deformation due to e.g. the squeezing force by the cap, is likely to be led.

In the present invention, the body, as shown by reference numeral 16 of FIG. 1 of the saturated polyester resin container is preferably heat-set by maintaining it in a mold heated to a temperature of from 50° to 140° C. at the time of the biaxial stretch blow molding. By such heat-setting, the crystallinity of the material can be increased, whereby when the temperature of the content rises to a level of from 50° to 70° C. at the time of heat sterilization, heat deformation and creeping of the container can be suppressed. The higher the temperature for the heat setting, the better the heat and pressure resistance of the container becomes. However, the time required for the cooling step to take out the container from the mold tends to be long accordingly, and the overall molding cycle tends to be long. From the balance of these two aspects, the temperature of the mold is preferably from 60° to 95° C.

Further, the periphery of the center of the bottom of the container and the portion of each valley line close to the center to be crystallized in the present invention are portions where crazing is likely to take place. Such crazing may further be accelerated by e.g. a lubricant in a conveyor line in the filling plant, whereby stress cracking is likely to occur. By crystallizing such portions, the chemical resistance of the material can also be improved, whereby formation of stress cracks can be suppressed.

Now, the present invention will be described in further detail with reference to Examples. However, it should be understood that the present invention is by no means restricted by such specific Examples.

EXAMPLE 1

Figure 2:
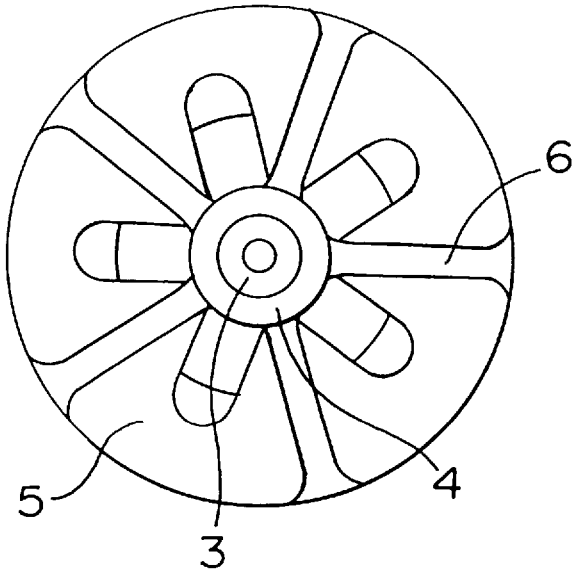
FIG. 2 is a bottom view of the self-sustaining container of the present invention prior to crystallization of the bottom.
Figure 3:
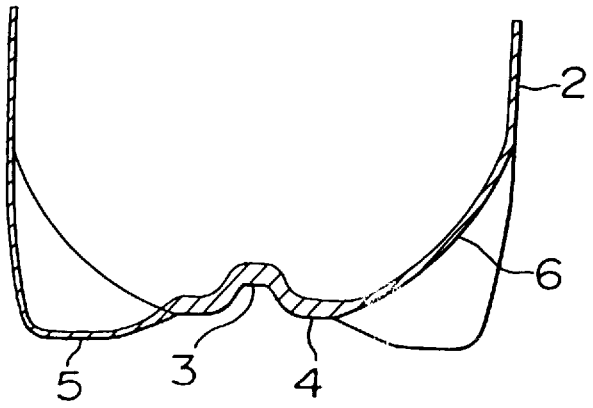
FIG. 3 is a cross-sectional view of the self-sustaining container of the present invention prior to crystallization of the bottom.
Figure 22:
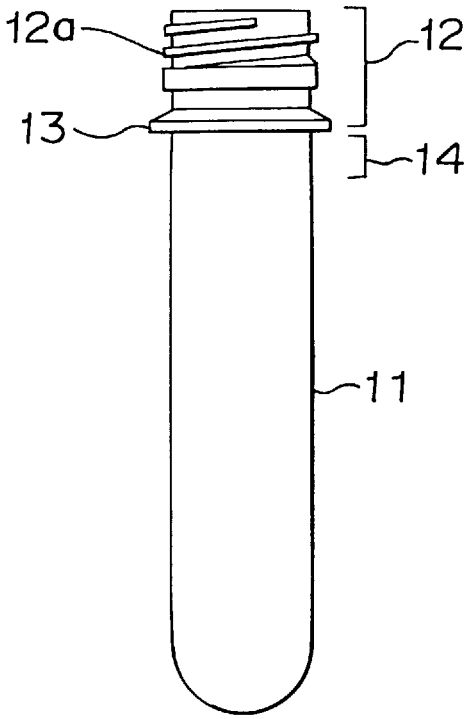
FIG. 22 is a front view of a preform to be used for the preparation of a self-sustaining container of the present invention.

A preform 11 (shown in FIG. 22) obtained by injection molding polyethylene terephthalate (IV=0.85), was reheated, then placed in a blow mold and subjected to biaxial stretch blow molding by stretching it in a circumferential direction by air blow while stretching in an axial direction by a stretch rod. At that time, heat setting was carried out for 5 seconds under such a condition that the body of the mold was heated to 90° C., and then an air of room temperature was circulated into the blow mold to cool the molded product, which was then taken out to obtain a self-supporting container. As shown in FIGS. 2 and 3, this self-sustaining container has a self-sustaining bottom structure with five legs 5 radially bulged in equal distances around the center 3 of the bottom and valley lines 6 formed between the adjacent legs 5, and it had a low stretched portion at the bottom.

Figure 4:
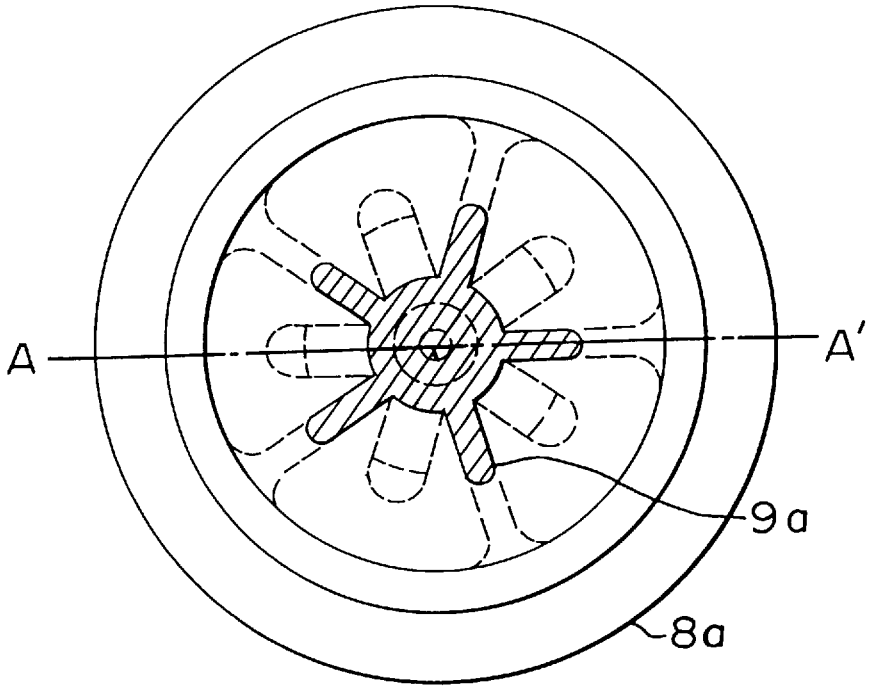
FIG. 4 is a plan view of a shielding plate used in Example 1, 3 or 9.
Figure 5:
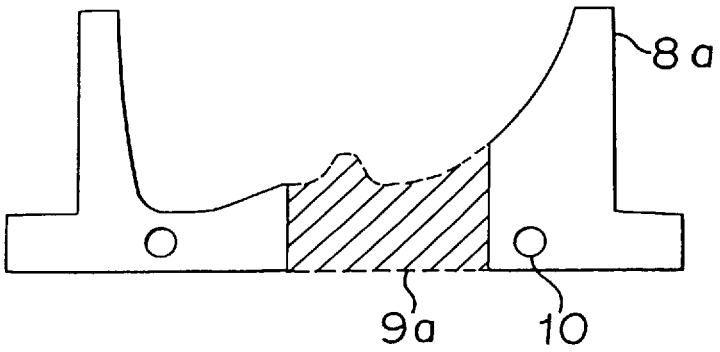
FIG. 5 is a cross-sectional view of the shielding plate used in Example 1, 3 or 9 taken along line A A' in FIG. 4.
Figure 6:
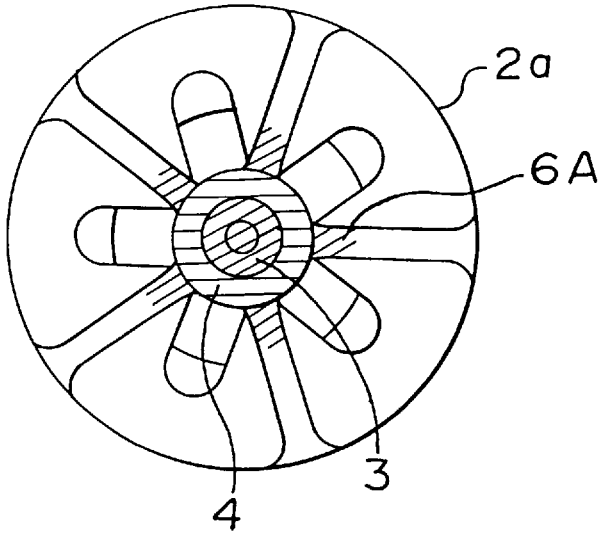
FIG. 6 is a bottom view of a self-sustaining container in Example 1, 3 or 9.

Then, the bottom of this self-sustaining container was placed in an upper cavity of a shielding plate 8*a* as shown in FIGS. 4 and 5, and the bottom of the self-sustaining container was heated through a slit by an infrared heater from below the shielding plate 8*a* (from the side opposite to the side of the shielding plate which fits the bottom of the container), to obtain a container having a container bottom 2*a* (shown in FIG. 6) in which the bottom center 3, the peripheral portion 4 of the bottom center and the portion 6*a* of each valley line close to the bottom center, were crystallized. The crystallized portions of the bottom of the self-sustaining container were cut, and the density was measured by a density gradient tube method and found to be 1.365 g/cm$^3$. The total height of this container was 305 mm, and the content level volume was 1.5 l. FIG. 33 shows a front view of this self-sustaining container.

Referring to the above description, the shielding plate 8*a* has substantially the same surface shape as the bottom surface of the container and has a slit 9*a* as shown in FIGS. 4 and 5. The radiation heat from the infrared heater passes through this slit and reaches the bottom of the container, whereby any desired portion can be crystallized by the heat. To the shielding plate, cooling water or hot water is circulated to maintain the temperature of the shielding plate at a constant level and thereby to prevent the portion of the shielding plate which contacts the container bottom from being heated to a high temperature exceeding Tg.

EXAMPLE 2

Figure 7:
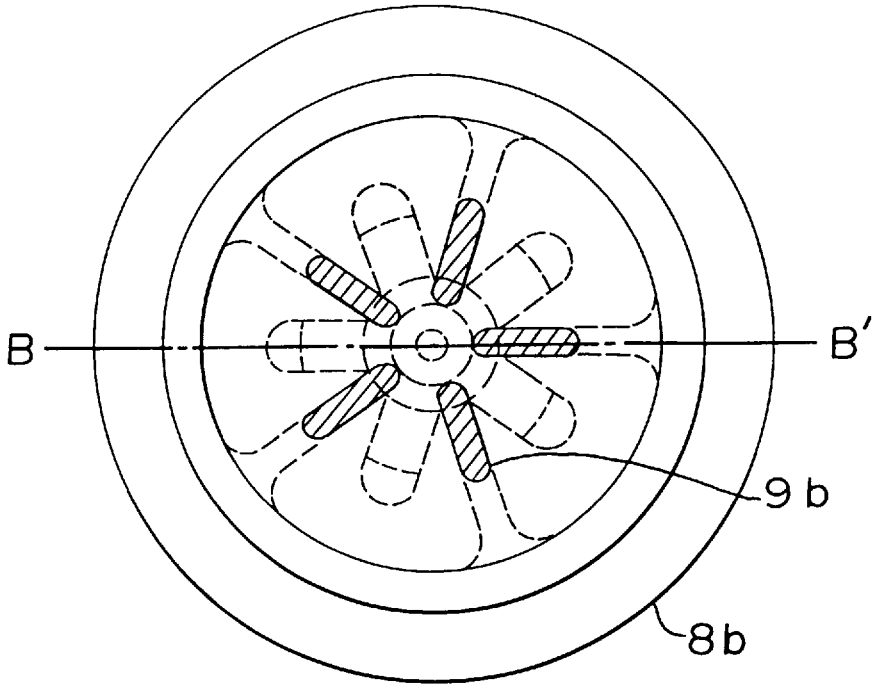
FIG. 7 is a plan view of a shielding plate used in Example 4 or 10.
Figure 8:
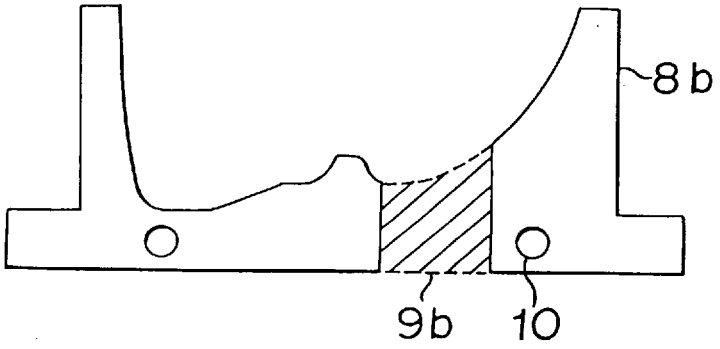
FIG. 8 is a cross-sectional view of a shielding plate used in Example 4 or 10 taken along line B B' in FIG. 7.
Figure 9:
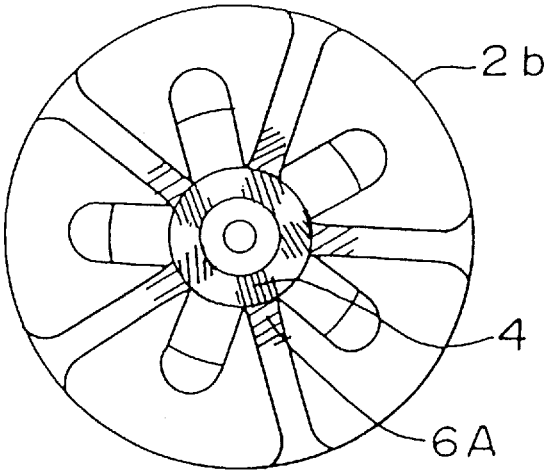
FIG. 9 is a bottom view of a self-sustaining container in Example 4 or 10.

Using a shielding plate 8*b* as shown in FIGS. 7 and 8, the bottom of a container was heated in the same manner as in Example 1 to obtain a container bottom 2*b* (shown in FIG. 9) wherein the peripheral portion 4 of the center of the bottom and the portion 6A of each valley line close to the center of the bottom, were crystallized. The crystallized portions of the bottom of the self-sustaining container were cut, and the density was measured and found to be 1.366 g/cm$^3$.

EXAMPLE 3

The mouth and cervical portion 12 and the portion 14 below the neck support ring at about 6 mm below the neck support ring 13 of a preform 11 (shown in FIG. 22) obtained by injection molding polyethylene terephthalate (IV=0.85) were heated and crystallized by an infrared heater. This preform except for the mouth and cervical portion was reheated, then placed in a blow mold and subjected to biaxial stretch blow molding by stretching in a circumferential direction by air blow while stretching in an axial direction by a stretch rod. At that time, heat setting was carried out for 5 seconds under such a condition that the body of the mold was heated to 90° C. Then, an air of room temperature was circulated into the blow mold to cool the molded product, which was then taken out to obtain a self-sustaining container. As shown in FIGS. 2 and 3, the self-sustaining container had a self-sustaining bottom structure with five legs 5 radially bulged in equal distances around the center 3 of the bottom and valley lines 6 formed between the adjacent legs 5.

Then, the bottom of this self-sustaining container was placed in an upper cavity of a shielding plate 8*a* as shown in FIGS. 4 and 5, and the bottom of the self-sustaining container was heated through a slit by an infrared heater from below the shielding plate 8*a* (from the side opposite to the side of the shielding plate which fits the bottom of the container), to obtain a container having a container bottom 2*a* (shown in FIG. 6) in which the bottom center 3, the peripheral portion 4 of the bottom center and the portion 6A of each valley line close to the bottom center, were crystallized. The crystallized portions of the bottom of the self-sustaining container was cut, and the density was measured by a density gradient tube method and found to be 1.363 g/cm$^3$. The total height of this container was 305 mm, and the content level volume was 1.5 l. FIG. 1 shows a front view of this self-sustaining container.

Referring to the above description, the shielding plate 8*a* has substantially the same surface shape as the bottom surface of the container and has a slit 9*a* as shown in FIGS. 4 and 5. The radiation heat from the infrared heater passes through this slit and reaches the bottom of the container, whereby any desired portion can be crystallized by the heat. To the shielding plate, cooling water or hot water is circulated to maintain the temperature of the shielding plate at a constant level and thereby to prevent the portion of the shielding plate which contacts the bottom of the container from being heated to a high temperature exceeding Tg.

EXAMPLE 4

Using a shielding plate 8*b* as shown in FIGS. 7 and 8, the bottom of a container was heated in the same manner as in Example 3 to obtain a container bottom 2*b* (shown in FIG. 9) in which the peripheral portion 4 of the bottom center and the portion 6A of each valley line close to the bottom center, were crystallized. The crystallized portions of the bottom of the self-sustaining container were cut, and the density was measured and found to be 1.366 g/cm$^3$.

EXAMPLE 5

Figure 10:
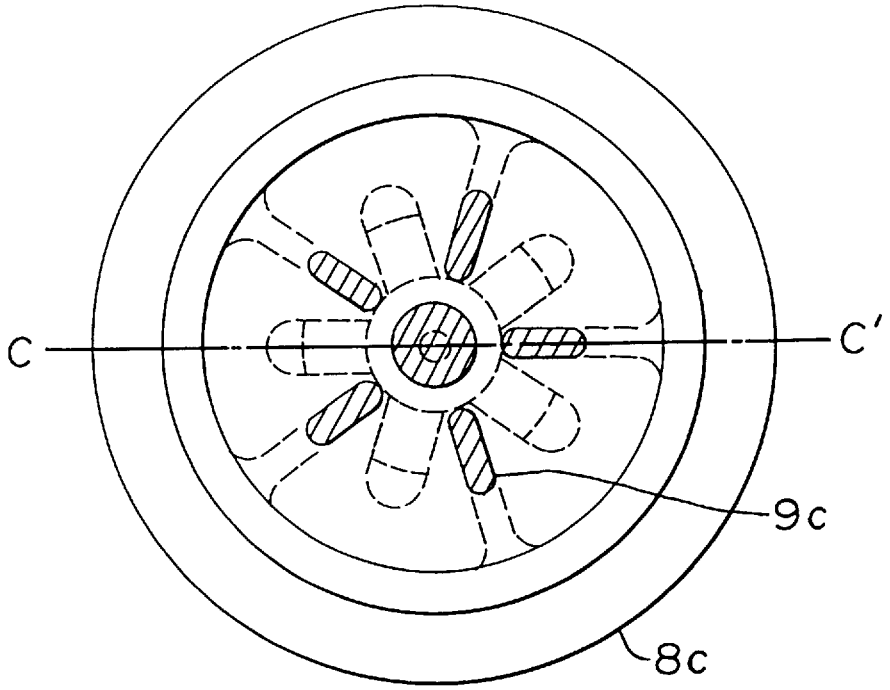
FIG. 10 is a plan view of a shielding plate used in Example 5 or 11.
Figure 11:
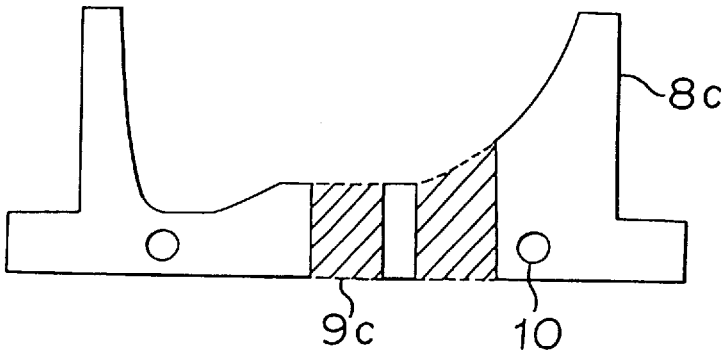
FIG. 11 is a cross-sectional view of the shielding plate used in Example 5 or 11 taken along line C C' in FIG. 10.
Figure 12:
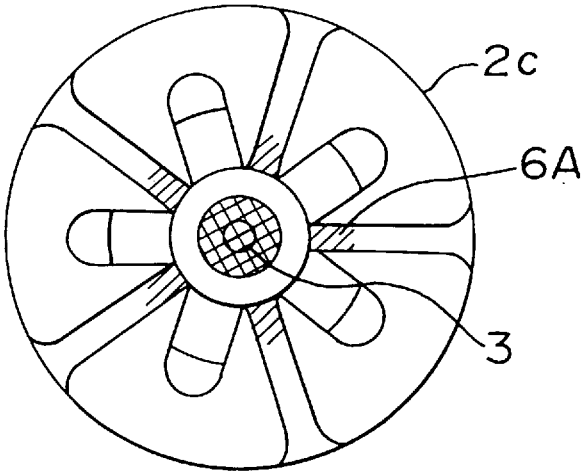
FIG. 12 is a bottom view of a self-supporting container in Example 5 or 11.

Using a shielding plate 8*c* as shown in FIGS. 10 and 11, the bottom of the container was heated in the same manner as in Example 3 to obtain a container bottom 2*c* (shown in FIG. 12) wherein the bottom center 3 and the portion 6A of each valley line close to the bottom center, were crystallized. The crystallized portions of the bottom of the self-sustaining container were cut, and the density was measured and found to be 1.365 g/cm$^3$.

EXAMPLE 6

Figure 13:
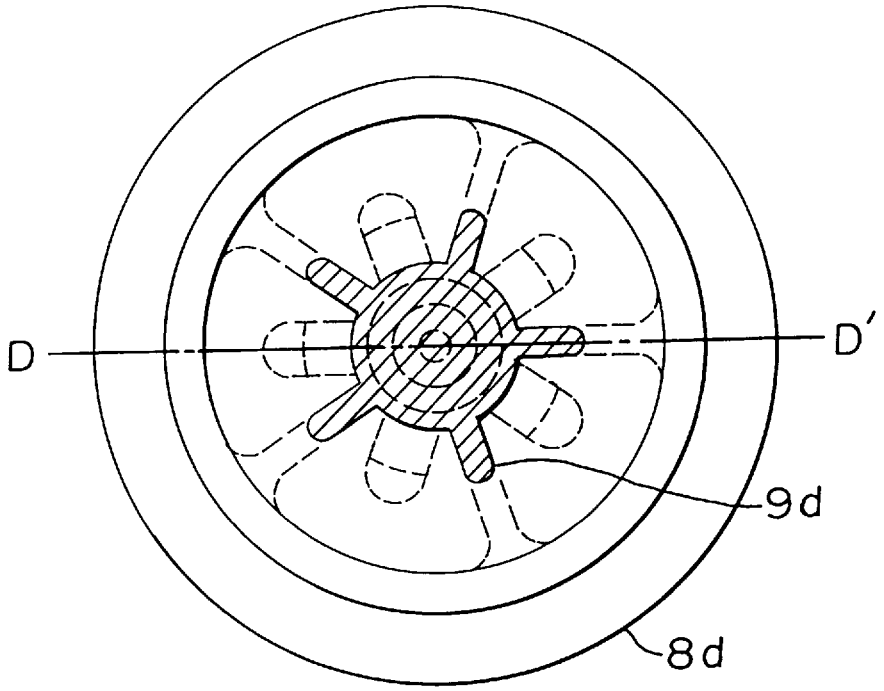
FIG. 13 is a plan view of a shielding plate used in Example 6 or 12.
Figure 14:
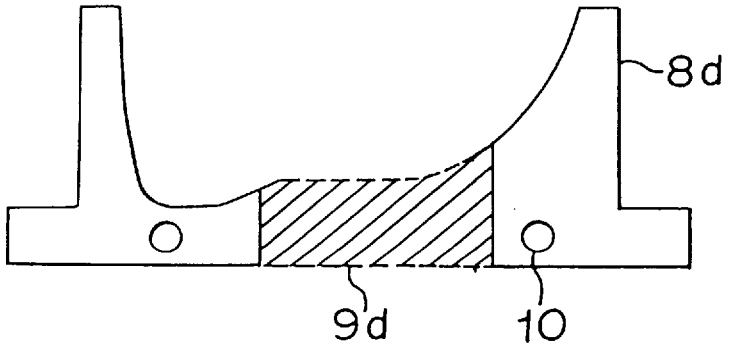
FIG. 14 is a cross-sectional view of the shielding plate used in Example 6 or 12 taken along line D D' in FIG. 13.
Figure 15:
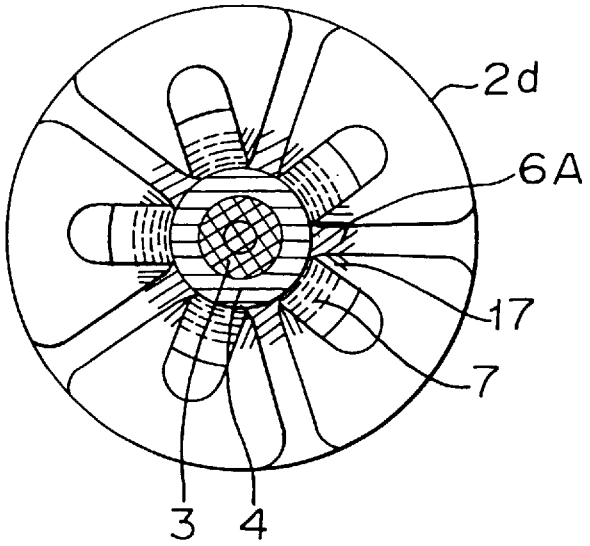
FIG. 15 is a bottom view of a self-supporting container in Example 6 or 12.

Using a shielding plate 8*d* as shown in FIGS. 13 and 14, the bottom of the container was heated in the same manner as in Example 3 to obtain a container bottom 2*b* (shown in FIG. 15) wherein the bottom center 3, the peripheral portion 4 of the bottom center, the portion 6A of each valley line close to the bottom center, and the portion 7 of each leg extending from the edge of the peripheral portion of the bottom center to a ground contact portion as well as the portion 17 between the portion of each valley line close to the bottom center and the portion of each leg extending from the edge of the peripheral portion of the bottom center to the ground contact portion, were crystallized. The crystallized portions of the bottom of the self-sustaining container were cut, and the density was measured and found to be 1.364 g/cm$^3$.

EXAMPLE 7

Figure 16:
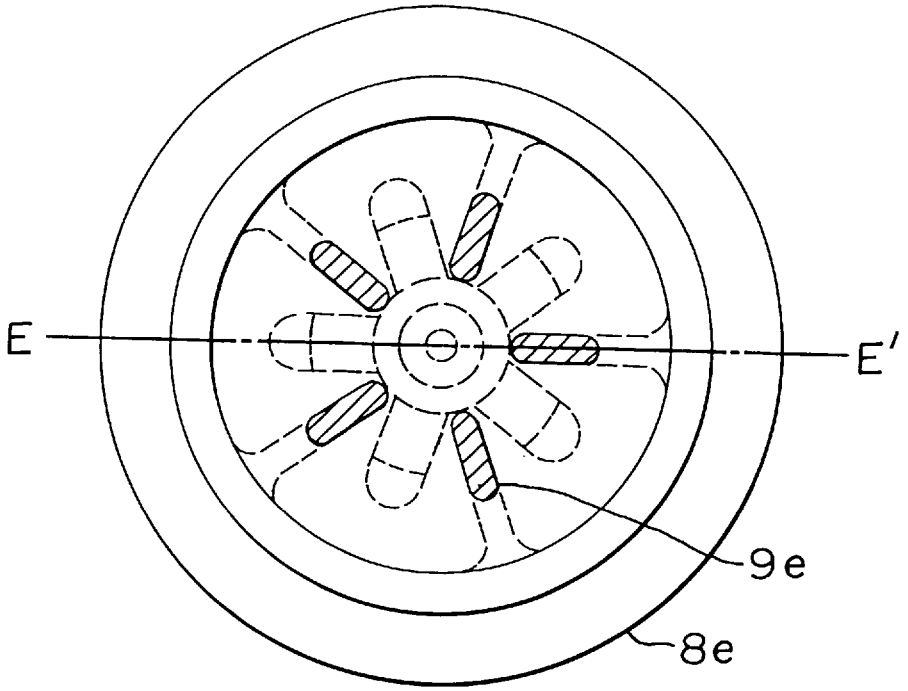
FIG. 16 is a plan view of a shielding plate used in Example 7 or 13.
Figure 17:
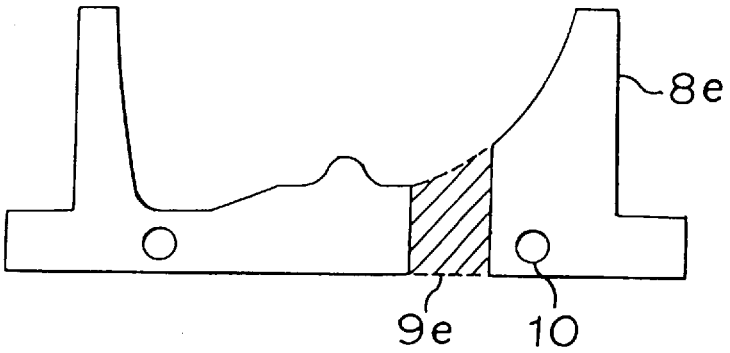
FIG. 17 is a cross-sectional view of the shielding plate used in Example 7 or 13 taken along line E E' in FIG. 16.
Figure 18:
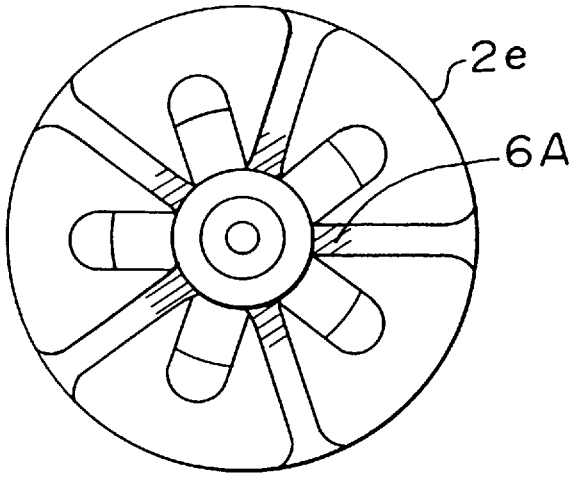
FIG. 18 is a bottom view of a self-sustaining container in Example 7 or 13.

Using a shielding plate 8*e* as shown in FIGS. 16 and 17, the bottom of a self-sustaining container was heated in the same manner as in Example 3 to obtain a container bottom 2*e* (shown in FIG. 18) wherein the portion 6A of each valley line close to the bottom center, was crystallized. In this operation, the time for heating the bottom was 1.5 times as long as in Example 3. The crystallized portions of the bottom of the self-sustaining container were cut, and the density was measured and found to be 1.375 g/cm$^3$.

EXAMPLE 8

Figure 19:
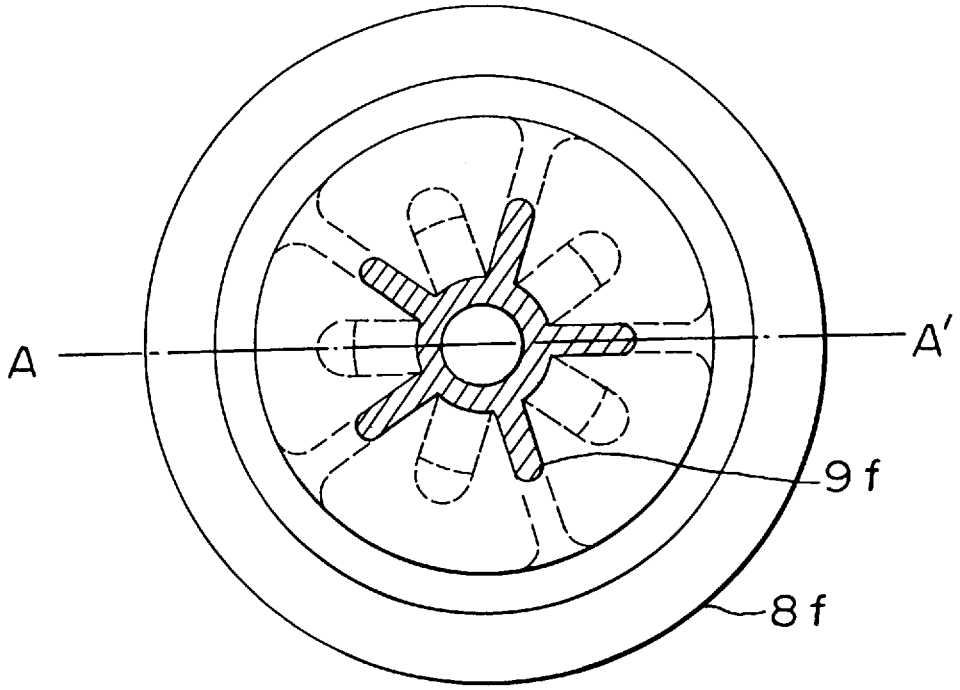
FIG. 19 is a plan view of a shielding plate used in Example 8 or 14.
Figure 20:
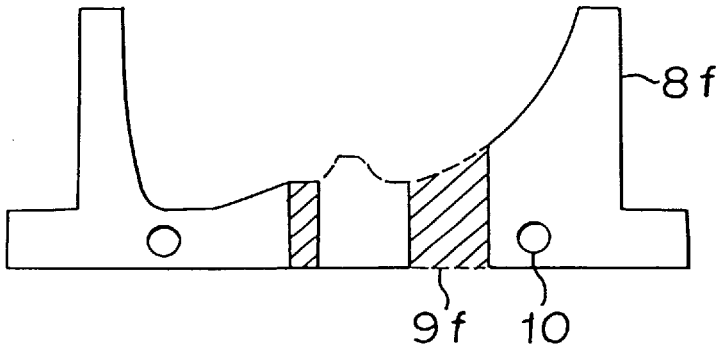
FIG. 20 is a cross-sectional view of the shielding plate used in Example 8 or 14 taken along line F F' in FIG. 19.
Figure 21:
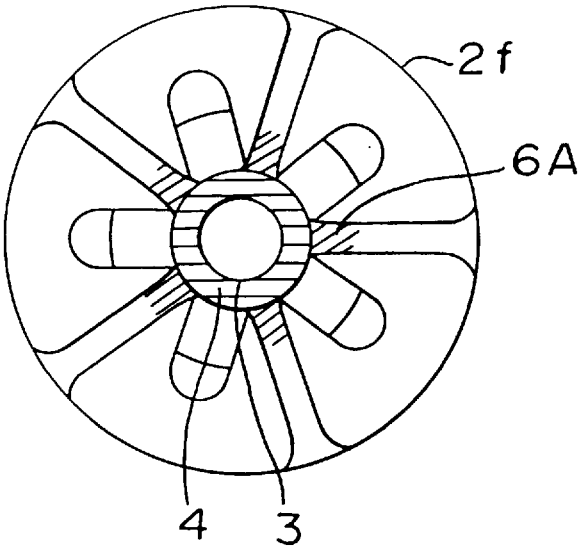
FIG. 21 is a bottom view of a self-sustaining container in Example 8 or 14.

Using a shielding plate 8*f* as shown in FIGS. 19 and 20, the bottom of a self-sustaining container was heated in the same manner as in Example 3 to obtain a container bottom 2*f* (shown in FIG. 21) wherein the peripheral portion 4 of the bottom center, the portion 6A of each valley line close to the bottom center and the portion 7 of each leg extending from the edge of the peripheral portion of the bottom center to the ground contact portion, were crystallized. The crystallized portions of the bottom of the self-sustaining container were cut, and the density was measured and found to be 1.366 g/cm$^3$.

EXAMPLE 9

Figure 28:
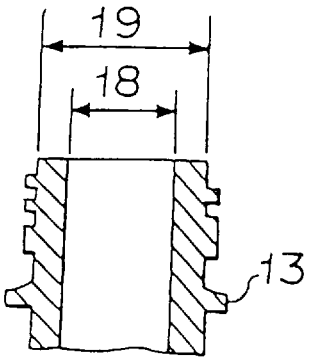
FIG. 28 is a cross-sectional view of the mouth and cervical portion of the preform to be used for the preparation of the self-sustaining container of the present invention.
Figure 30:
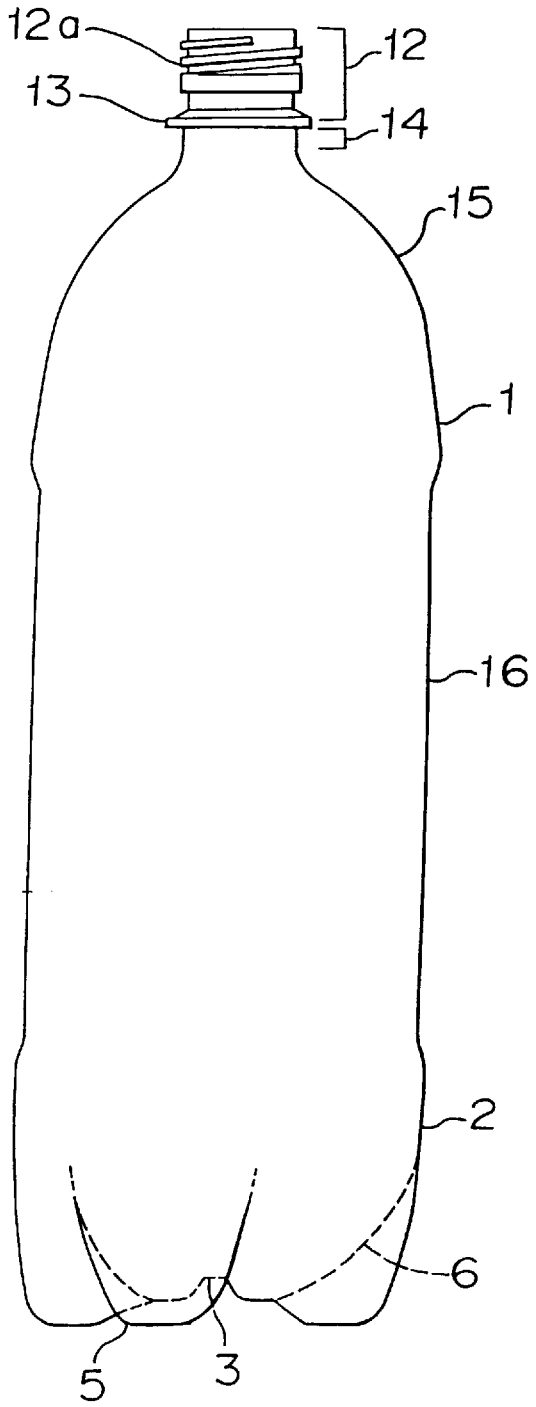
FIG. 30 is a front view of a self-sustaining container of the present invention.
Figure 31:
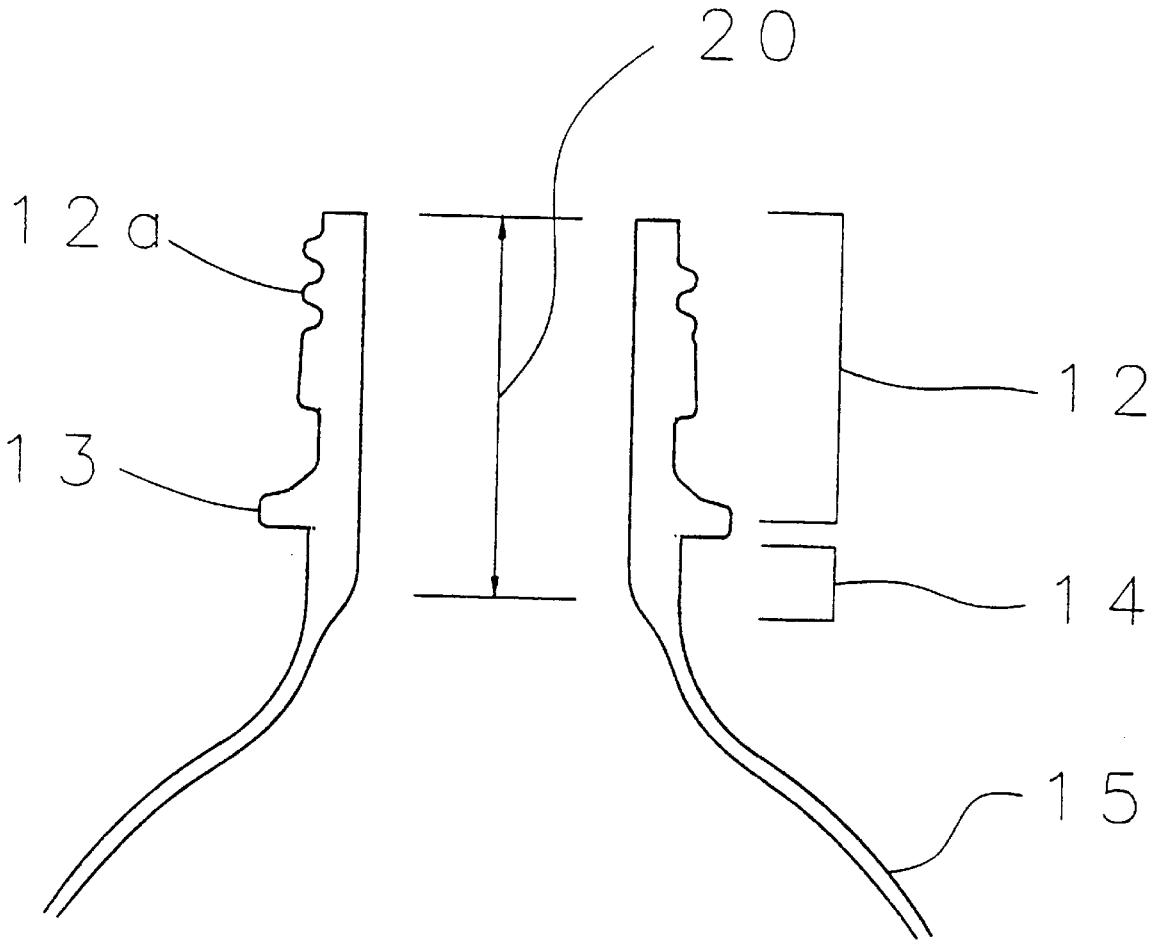
FIG. 31 is a cross-sectional view of the upper part of a self-sustaining container according to the present invention from the shoulder portion to the mouth portion.

The portion 14 below the neck support ring at about 6 mm below the neck support ring 13 of a preform 11 (shown in FIG. 22) obtained by injection molding polyethylene terephthalate (IV=0.85), was locally heated and crystallized by an infrared heater. Further, the threaded portion 12*a* of the mouth and cervical portion was heated at 100° C. for 20 minutes and then gradually cooled to reduce the residual internal stress and strain. The inner diameter 18 of the mouth and cervical portion of this preform was adjusted to be 76% of the outer diameter 19 (shown in FIG. 28). This preform except for the mouth and cervical portion and the portion below the neck support ring, was reheated, then placed in a blow mold and subjected to biaxial stretch blow molding by stretching in a circumferential direction by air blow while stretching in an axial direction by a stretch rod. At that time, heat-setting was carried out for 5 minutes under such a condition that the body of the mold was heated at 90° C. Then, an air of room temperature was circulated into the blow mold to cool the molded product, which was then taken out to obtain a container. As shown in FIGS. 2 and 3, this container had a self-sustaining bottom structure with five legs 5 radially bulged in equal distances around the center 3 of the bottom and valley lines 6 formed between the adjacent legs 5, and it had a low stretched portion at its bottom.

Figure 29:
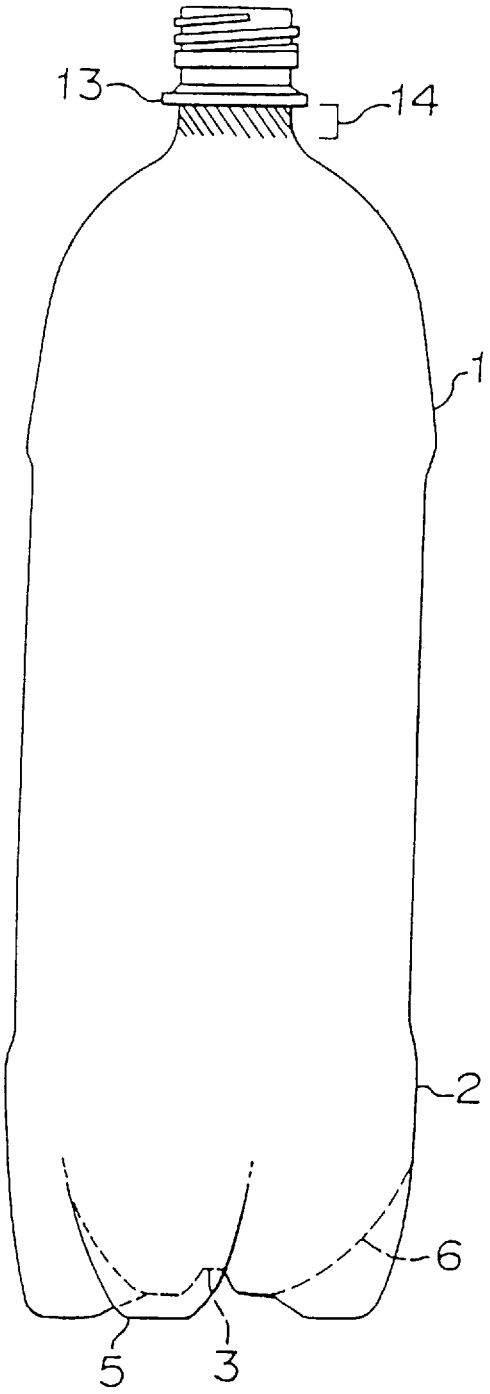
FIG. 29 is a front view of a self-sustaining container of the present invention.

Then, this container was placed on a shielding plate 8*a* as shown in FIGS. 4 and 5, and the bottom of the container was heated by an infrared heater from below the shielding plate 8*a*, to obtain a self-sustaining container having a container bottom 2*a* (shown in FIG. 6) in which the bottom center 3, the peripheral portion 4 of the bottom center and the portion 6*a* of each valley line close to the bottom center, were crystallized. The crystallized portions of the bottom of the self-sustaining container were cut, and the density was measured by a density gradient tube method and found to be 1.365 g/cm$^3$. The total height of this container was 305 mm, and the content level volume was 1.5 l. The inner diameter of the mouth and cervical portion of the container was 76% of the outer diameter thereof. FIG. 29 shows a front view of this self-sustaining container.

Referring to the above description, the shielding plate 8*a* has substantially the same surface shape as the bottom surface of the container and has a slit 9*a* as shown in FIGS. 4 and 5. The radiation heat from the infrared heater passes through this slit and reaches the bottom of the container, whereby any desired portion can be crystallized by the heat. To the shielding plate, cooling water or hot water is circulated to maintain the surface temperature of the shielding plate at a constant level and thereby to prevent the portion of the shielding plate which contacts the bottom of the container from being heated to a high temperature exceeding Tg of the material.

EXAMPLE 10

Using a shielding plate 8*b* as shown in FIGS. 7 and 8, the bottom of the container was heated in the same manner as in Example 9 to obtain a container bottom 2*b* (shown in FIG. 9) wherein the peripheral portion 4 of the bottom center and the portion 6A of each valley line close to the bottom center, were crystallized. The crystallized portions of the bottom of the self-sustaining container were cut, and the density was measured and found to be 1.363 g/cm$^3$. The total height of this container was 305 mm, the content level volume was 1.5 l, and the inner diameter of the mouth and cervical portion of the container was 75% of the outer diameter thereof.

EXAMPLE 11

Using a shielding plate 8*c* as shown in FIGS. 10 and 11, the bottom of a container was heated in the same manner as in Example 9 to obtain a container bottom 2*c* (shown in FIG. 12) wherein the bottom center 3 and the portion 6A of each valley line close to the bottom center, were crystallized. The crystallized portions of the bottom of the self-sustaining container were cut, and the density was measured and found to be 1.365 g/cm$^3$. The total height of this container was 305 mm, the content level volume was 1.5 l, and the inner diameter of the mouth and cervical portion of the container was 76% of the outer diameter thereof.

EXAMPLE 12

Using a shielding plate 8*b* as shown in FIGS. 13 and 14, the bottom of a container was heated in the same manner as in Example 9 to obtain a container bottom 2*d* (shown in FIG. 15) wherein the bottom center 3, the peripheral portion 4 of the bottom center, the portion 6A of each valley line close to the bottom center, the portion 7 of each leg extending from the edge of the peripheral portion of the bottom center to the ground contact portion, and the portion 17 between the portion of each valley line close to the bottom center and the portion of each leg extending from the edge of the peripheral portion of the bottom center to the ground contact portion, were crystallized. The crystallized portions of the bottom of the self-sustaining container were cut, and the density was measured and found to be 1.366 g/cm$^3$. The total height of this container was 305 mm, the content level volume was 1.5 l, and the inner diameter of the mouth and cervical portion of the container was 76% of the outer diameter thereof.

EXAMPLE 13

Using a shielding plate 8*e* as shown in FIGS. 16 and 17, the bottom of a self-sustaining container was heated in the same manner as in Example 9 to obtain a container bottom 2*e* (shown in FIG. 18) in which the portion 6A of each valley line close to the bottom center, was crystallized. The crystallized portion of the bottom of the self-sustaining container was cut, and the density was measured and found to be 1.375 g/cm$^3$. The total height of this container was 305 mm, the predetermined volume was 1.5 l, and the inner diameter of the mouth and cervical portion of the container was 76% of the outer diameter thereof.

EXAMPLE 14

Using a shielding plate 8*f* as shown in FIGS. 19 and 20, the bottom of a self-sustaining container was heated in the same manner as in Example 9 to obtain a container bottom 2*f* (shown in FIG. 21) wherein the peripheral portion 4 of the bottom center, the portion 6A of each valley line close to the bottom center and the portion 7 of each leg extending from the edge of the peripheral portion of the bottom center to the ground contact portion, were crystallized. The crystallized portions of the bottom of the self-sustaining container were cut, and the density was measured and found to be 1.366 g/cm$^3$.

COMPARATIVE EXAMPLE 1

The operation was conducted in the same manner as in Example 1 except that no heating or thermal crystallization of the container bottom was conducted. The obtained hollow container was the one wherein the bottom was not crystallized at all.

COMPARATIVE EXAMPLE 2

The operation was conducted in the same manner as in Example 3 except that only the mouth and cervical portion of the preform was crystallized, and no heating or thermal crystallization of the container bottom was carried out. The obtained hollow container was the one wherein only the mouth and cervical portion was crystallized, and the bottom was not crystallized at all.

COMPARATIVE EXAMPLE 3

The operation was conducted in the same manner as in Example 3 except that the mouth and cervical portion and the portion below the neck support ring at about 6 mm below the neck support ring of the preform were crystallized, and no heating or thermal crystallization of the container bottom was carried out. The obtained hollow container was the one wherein only the mouth and cervical portion was crystallized, and the bottom was not crystallized at all.

Evaluation Methods and Results (1) Self-sustaining Stability

The one wherein the center of the bottom projects downwardly beyond the contact ground plane of the legs, was identified by symbol × i.e. "bad", and the one wherein the center portion of the bottom does not so projected, was identified by symbol ○ i.e. "good".

(2) Degree of Lowering of the Content Level

The difference in the height from the forward end of the mouth and cervical portion of the hollow container to the liquid surface of the container was obtained as between before and after the test. A degree of lowering which is not more than 20 mm, is evaluated as "good".

(3) Change in the Inner Diameter of the Mouth and Cervical Portion

The inner diameter of the mouth and cervical portion was measured before and after the test in such a state that the cap was removed, and the difference in the inner diameter was obtained.

(4) Change in the Total Height

The total height of the container was measured before and after the test, and the difference was obtained.

12 Samples were prepared for each of the self-sustaining containers obtained in Examples 1 to 14 and Comparative Examples 1 to 3, and carbonated water having 2.5 gas volume was filled to a content level of 43 mm at 5° C. Then, they were capped and subjected to hot water shower of 70° C. for 30 minutes. Then, they were subjected to shower of water of 20° C. for 10 minutes for cooling, followed by evaluation. The results of evaluation of the self-sustaining stability (projection of the bottom) and the results of evaluation of the degree of lowering of the content level (the average value of 12 samples) are shown in Tables 1 and 2. Further, the caps were removed, and the change in the inner diameter of the mouth and cervical portion relative to the one prior to filling, as well as the change in the total height of the container, were measured, and the results (the average value of 12 samples) are shown in Tables 1 and 2.

TABLE 1

| | Self-sustaining stability | Degree of lowering of the content level (mm) | Change in the inner diameter of the mouth and cervical portion (mm) | Change in the total height (mm) |
|---|---|---|---|---|
| Example 1 | ○ | 12 | 0.08 | 5 |
| Example 2 | ○ | 13 | 0.08 | 5 |
| Example 3 | ○ | 12 | 0.04 | 5 |
| Example 4 | ○ | 13 | 0.04 | 5 |
| Example 5 | ○ | 17 | 0.04 | 5 |
| Example 6 | ○ | 15 | 0.04 | 5 |
| Example 7 | ○ | 18 | 0.04 | 5 |
| Example 8 | ○ | 13 | 0.04 | 5 |
| Example 9 | ○ | 12 | 0.05 | 5 |
| Example 10 | ○ | 14 | 0.05 | 5 |
| Example 11 | ○ | 17 | 0.05 | 5 |
| Example 12 | ○ | 15 | 0.05 | 5 |
| Example 13 | ○ | 18 | 0.05 | 5 |
| Example 14 | ○ | 13 | 0.04 | 5 |

TABLE 2

| | Self-sustaining stability | Degree of lowering of the content level (mm) | Change in the inner diameter of the mouth and cervical portion (mm) | Change in the total height (mm) |
|---|---|---|---|---|
| Comparative Example 1 | X | 26 | 0.08 | (Note 1) |
| Comparative Example 2 | X | 22 | 0.07 | (Note 1) |
| Comparative Example 3 | X | 23 | 0.04 | (Note 1) |

Note 1:
Not measurable because of poor self-sustaining stability.

From the test results of Examples 1 to 14 and Comparative Examples 1 to 3, it should be understood that the containers of the present invention are excellent in suppressing the projection of the bottom due to creeping at the time of heat sterilization to prevent lowering of the content level and in maintaining the self-sustaining stability.

Figure 23:
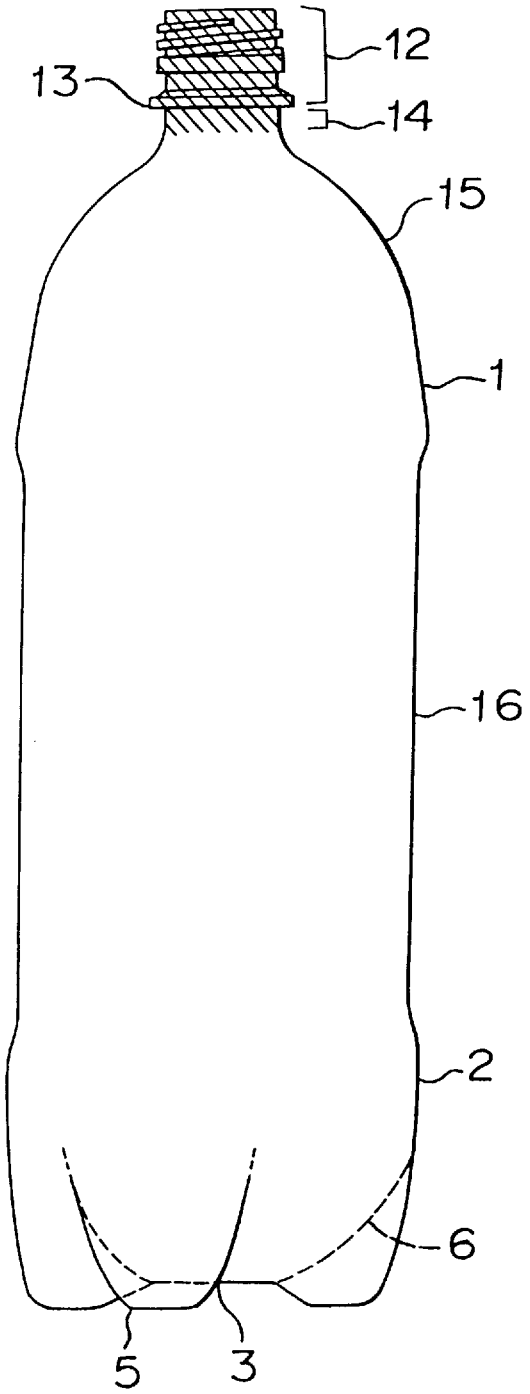
FIG. 23 is a front view of a self-sustaining container having a different shape.
Figure 24:
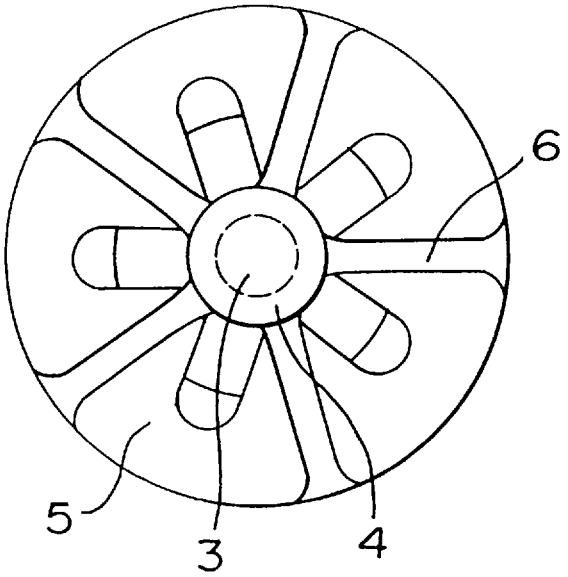
FIG. 24 is a bottom view of the self-sustaining container shown in FIG. 23 prior to crystallization of the bottom.
Figure 25:
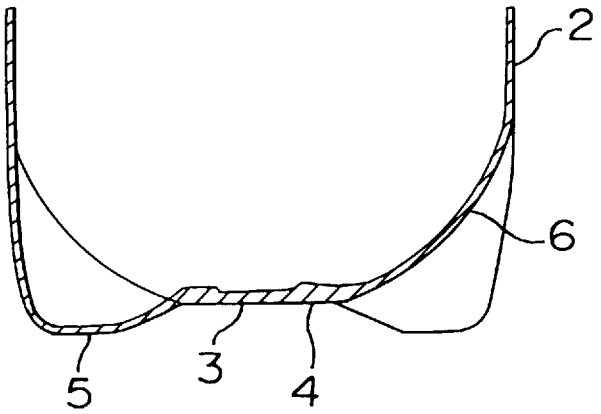
FIG. 25 is a cross-sectional view of the bottom of the self-sustaining container shown in FIG. 23.

The structure of the bottom of the container in the present invention is not limited to the specific structures illustrated in the Examples of the present invention, and similar effects can be obtained with other structures similar to those in the Examples of the present invention. As an example of a self-sustaining container different in the shape from Example 3, a container as shown in FIGS. 23, 24 and 25 may be mentioned, and as an example of a self-sustaining container different in the shape from Example 9, a container as shown in FIGS. 29, 24 and 25 may be mentioned. FIG. 34 shows the top part of a self-sustaining container according to the present invention, with the mouth portion designated by reference numeral 20.

As described in the foregoing, the self-sustaining container of the present invention is a heat and pressure resistant self-sustaining container which is capable of suppressing projection of the bottom to maintain the self-sustaining stability at the time of heat sterilization of the content, which is excellent also in the chemical resistance and heat resistance of the mouth and cervical portion, which is capable of preventing creeping of the neck and which is excellent also in the heat and pressure resistance of the body. Further, the container of the present invention requires no base cup, whereby hot water sufficiently reaches the bottom of the container at the time of heat sterilization treatment, and the heat sterilization of the content can be carried out smoothly. Furthermore, it facilitates reuse of a used container.

What is claimed is:

1. A method for suppressing creeping in a self-sustaining container made of a saturated polyester resin, and formed by biaxial stretch blow molding and comprising a mouth and cervical portion, a shoulder, a body and a bottom, wherein said bottom has a self-sustaining structure with a plurality of legs radially bulged around the center of the bottom and valley lines formed between the adjacent legs, and the following portions (A) to (E) are low draw ratio portions, (A) center of the bottom (B) peripheral portion of the center of the bottom (C) portion of each valley line close to the center of the bottom (D) portion of each leg from the edge of the peripheral portion of the center of the bottom to a ground contact portion (E) portion between said portions (C) and (D), said method comprising crystallizing at least portions (B) and (C) among said portions (A) to (E) by providing a shielding plate having a slit, between the bottom of said container and a heating source, wherein the side of the shielding plate adjacent the bottom of the container is shaped to fit said bottom and the slit is in registry with said portions to be crystallized, and providing heat from said heat source in an amount sufficient to maintain the surface temperature of the shielding plate at a constant level no higher than the Tg of the material of the container and in an amount sufficient for said crystallizing.

2. The method of claim 1, additionally comprising crystallizing said mouth and cervical portion, and a non-stretched portion of a neck connecting said mouth and cervical portion and said shoulder.

3. The method of claim 1, wherein the inner diameter of said mouth and cervical portion is from 60 to 90% of the outer diameter of said mouth and cervical portion, said mouth and cervical portion has a threaded section, at least this threaded section has residual internal stress and strain reduced by heat treatment, and said method additionally comprising crystallizing a non-stretched portion of a neck connecting said mouth and cervical portion and said shoulder.

4. The method of claim 1, wherein the crystallized portion of the bottom has a density of from 1.350 g/cm$^3$ to 1.390 g/cm$^3$.

5. The method of claim 2, wherein the crystallized portion of the bottom has a density of from 1.350 g/cm$^3$ to 1.390 g/cm$^3$.

6. The method of claim 3, wherein the crystallized portion of the bottom has a density of from 1.350 g/cm$^3$ to 1.390 g/cm$^3$.

7. The method of claim 1, wherein said body of said container is heat-set by maintaining it in a mold heated to a temperature of from 50° to 140° C. at the time of said biaxial stretch blow molding.

8. The method of claim 2, wherein said body of said container is heat-set by maintaining it in a mold heated to a temperature of from 50° to 140° C. at the time of said biaxial stretch blow molding.

9. The method of claim 3, wherein said body of said container is heat-set by maintaining it in a mold heated to a temperature of from 50° to 140° C. at the time of said biaxial stretch blow molding.

10. The method of claim 4, wherein said body of said container is heat-set by maintaining it in a mold heated to a temperature of from 50° to 140° C. at the time of said biaxial stretch blow molding.

11. The method of claim 5, wherein said body of said container is heat-set by maintaining it in a mold heated to a temperature of from 50° to 140° C. at the time of said biaxial stretch blow molding.

12. The method of claim 6, wherein said body of said container is heat-set by maintaining it in a mold heated to a temperature of from 50° to 140° C. at the time of said biaxial stretch blow molding.

13. The method of claim 1, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

14. The method of claim 2, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

15. The method of claim 3, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

16. The method of claim 4, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

17. The method of claim 5, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

18. The method of claim 6, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

19. The method of claim 7, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

20. The method of claim 8, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

21. The method of claim 9, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

22. The method of claim 10, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

23. The method of claim 11, wherein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

24. The method of claim 12, therein the crystallized portions of the bottom are selected from the group consisting of:

(a) combination of (A), (B) and (C), (b) combination of (A), (B), (C) and (D), (c) combination of (A), (B), (C), (D) and (E), (d) combination of (B), (C) and (D), and (e) combination of (B), (C), (D) and (E).

* * * * *